US005513576A

United States Patent [19]

Ward

[11] Patent Number: 5,513,576

[45] Date of Patent: May 7, 1996

[54] ADJUSTABLE LAP TABLE

[76] Inventor: Thomas A. Ward, 1942 Kristy La., Holts Summit, Mo. 65043

[21] Appl. No.: 367,715

[22] Filed: Jan. 3, 1995

[51] Int. Cl.[6] ..... A47B 23/00

[52] U.S. Cl. ..... 108/43; 108/67

[58] Field of Search ..... 108/43, 42, 67; 248/444; 211/88, 132, 135, 69.8, 72; 160/738

[56] References Cited

U.S. PATENT DOCUMENTS

| | | | |
|---|---|---|---|
| 154,126 | 8/1874 | Cotton | 108/43 |
| 2,647,716 | 8/1953 | Hudziak et al. | 108/43 X |
| 2,670,260 | 2/1954 | Watt | 108/43 X |
| 3,884,159 | 5/1975 | Faria | 108/67 X |
| 4,026,219 | 5/1977 | Shupe et al. | 108/67 X |
| 4,809,760 | 3/1989 | Lew | 160/238 X |
| 4,848,437 | 7/1989 | Laniado et al. | 160/238 X |
| 4,958,577 | 9/1990 | Demaio et al. | 108/43 |
| 5,221,032 | 6/1993 | Bott et al. | 108/43 X |
| 5,355,811 | 10/1994 | Brewer | 108/43 |

FOREIGN PATENT DOCUMENTS

| | | | |
|---|---|---|---|
| 485126 | 5/1938 | United Kingdom | 108/43 |

*Primary Examiner*—Jose V. Chen

[57] ABSTRACT

A self adjusting lap table includes a strap to maintain the table in a coiled position when not in use. When used the storage strap is released and the lap table is uncoiled and placed on the users lap. When the table is placed on the users lap it tends to return to the coiled position causing the table edges to grip the users legs. Openings in the table top provide locations to insert drinking cups or other items.

5 Claims, 2 Drawing Sheets

ADJUSTABLE LAP TABLE

BACKGROUND OF THE INVENTION

1. Field of the Invention

The subject invention generally pertains to a platform or table placed on a persons lap while they are seated.

2. Description of Related Art

The disadvantages of current lap tables is that they do not provide a method to grip the users legs to prevent said table from falling off. They do not automatically adjust to the users size. They have no provision to hold a drinking cup or other item in a secure manner. They cannot be rolled up to reduce the space needed for storage.

SUMMARY OF THE INVENTION

To avoid the limitations and problems with the current designs of lap tables it is an object of the subject invention to provide a method to automatically adjust to the size of the user and grip their legs to secure the table to the users lap.

Another feature of the invention is to provide locations or openings in the table surface where a drinking cup or other item can be placed to maintain it in a secure manner.

Another object of the invention is to provide a method to maintain the lap table in a coiled or rolled up configuration when not in use.

These and other objects of the invention are provided by a novel lap table that includes a top fabricated from a flexible material that will curl up at the edges and grip the users legs when it is placed on the users lap. Openings in the top where a drinking cup or other item may be held are located so they will be between the users legs when the table is being used. A strap or other device to maintain the top in a coiled configuration when not in use is attached to one end of the table.

DESCRIPTION OF THE PREFERRED EMBODIMENT

Figure 1:
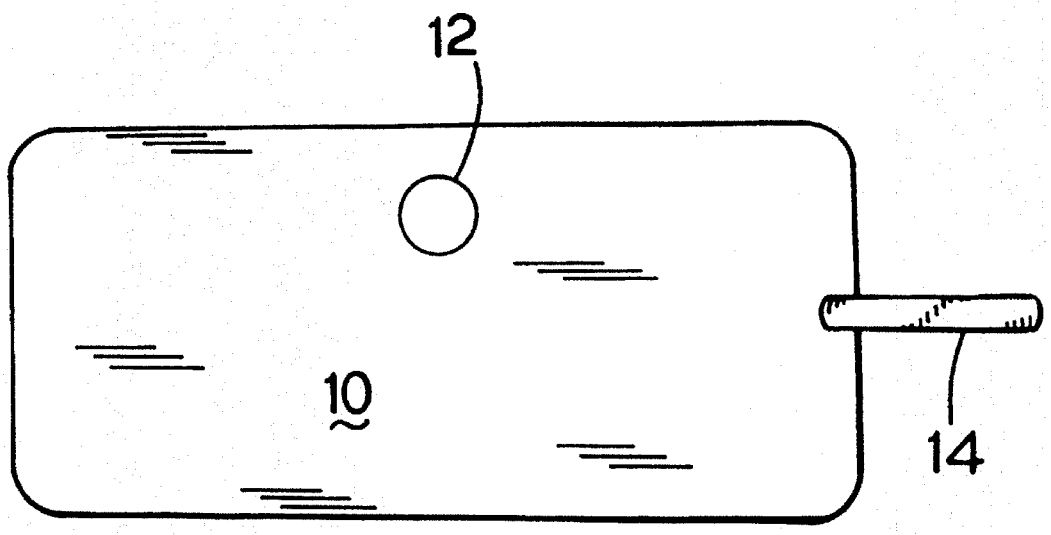
FIG. 1 illustrates the lap table in the uncoiled position with the storage strap attached to the edge.

Referring to FIG. 1, a platform used as a lap table includes a flexible table top 10 with an opening 12 in it. A flexible strap 14 is attached to the edge of the table top to act as a device to maintain said table top in a coiled configuration when not in use. In one embodiment of the invention table top 10 is fabricated of the material polyethylene. This material, after being formed into a coiled or rolled up configuration will tend to recoil or reroll when it is straightened out and then released.

However, it should be appreciated by those skilled in the art that any material capable of being coiled or rolled up then tending to recoil or reroll after being straightened and released would work.

Figure 2:
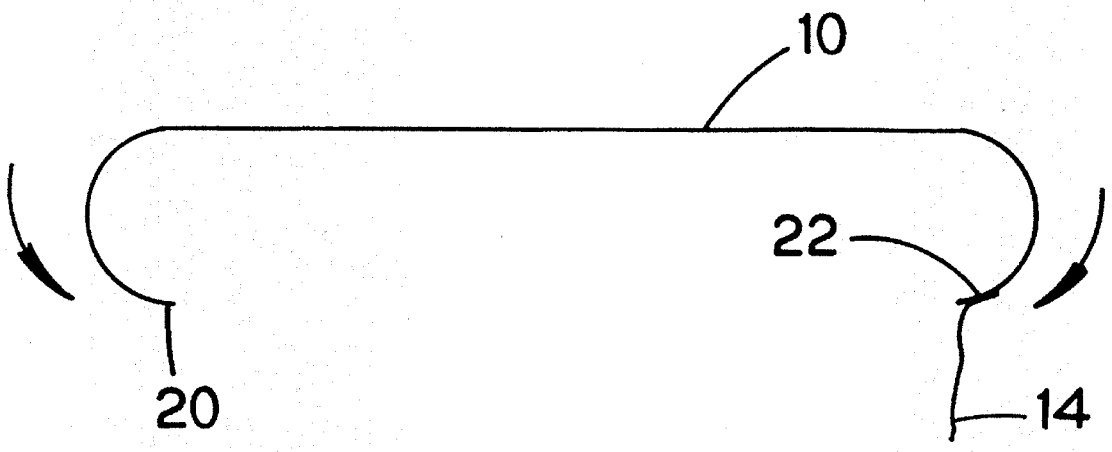
FIG. 2 illustrates the lap table ready to be placed on the users lap showing the table ends as they recoil.

Referring to FIG. 2, storage strap 14 is released to allow table top 10 to be uncoiled. After table top 10 is uncoiled and placed on the lap of the user such that as table top 10 tends to recoil edges 20 and 22 will press against the users legs holding table top 10 securely in position.

Table top 10 is positioned on the users lap such that opening 12 is located between the users legs so that a drinking cup or other item may be placed in opening 12 and held by the users legs. When not in use table top 10 is placed into a coiled configuration and held in that position by storage strap 14.

In one embodiment of the invention, storage strap 14 is held in the closed position by the use of a hook and loop device commonly known as "VELCRO", manufactured by VELCRO Inc. of New Hampshire.

Although the invention is described with respect to a preferred embodiment, modifications thereto will be apparent to those skilled in the art. Therefore, the scope of the invention is to be determined by reference to the claims which follow.

What is claimed is:

1. An adjustable lap table that automatically grips a users legs comprising:

a platform for setting upon a users lap, said platform being made from a generally rectangular piece of material and said material having the characteristic that once rolled will tend to reroll when straightened;

a flexible table top being a center area of said platform;

a pair of gripping coils located at opposite ends of said platform, said flexible table top being positioned between said gripping coils, said gripping coils formed by said ends of said platform rerolling when said platform is unrolled, said gripping coils being positioned and made from a material to enable said gripping coils to automatically reroll around and grip the legs of said user and automatically adjusting to fit the user by the rerolling ends;

a storage strap attached to one end of said platform, said storage strap maintaining said platform in a rolled configuration when not in use; and an opening through said flexible table top, said opening for receiving a drinking cup or other such items.

2. The adjustable lap table as set forth in claim 1 in which said platform is made from polyethylene.

3. An adjustable lap table that automatically grips a users legs comprising:

a flexible table top for placement on a users lap and stored in a rolled configuration when not in use; and a pair of gripping coils made from a material to enable said gripping coils to automatically reroll after being unrolled, each located at opposite ends of said flexible table top, said gripping coils formed by recoiling of said flexible table top after said flexible table top is unrolled, said flexible table top being positioned to permit said gripping coils to automatically reroll around and grip the legs of the user when recoiling and adjusting for the users size.

4. The adjustable lap table as set forth in claim 3 further comprising a storage strap attached to one end of said flexible table top, said storage strap securing said flexible table top in a rolled configuration when not in use.

5. The adjustable lap table as set forth in claim 3 further comprising an opening through said flexible table top for receiving and holding a drinking cup.

* * * * *